US007476117B1

(12) United States Patent
Chen et al.

(10) Patent No.: US 7,476,117 B1
(45) Date of Patent: Jan. 13, 2009

(54) ELECTRICAL CONNECTOR

(75) Inventors: Chun-Hua Chen, Chung Ho (TW); Chun-Hsu Chen, Chung Ho (TW)

(73) Assignee: Jess-Link Products Co., Ltd., Chung Ho (TW)

( * ) Notice: Subject to any disclaimer, the term of this patent is extended or adjusted under 35 U.S.C. 154(b) by 0 days.

(21) Appl. No.: 12/120,986

(22) Filed: May 15, 2008

(51) Int. Cl.
*H01R 13/627* (2006.01)

(52) U.S. Cl. ..... 439/352

(58) Field of Classification Search ..... 439/352, 439/357, 358

See application file for complete search history.

(56) References Cited

U.S. PATENT DOCUMENTS 5,915,987 A 6/1999 Reed et al.
6,648,665 B1 11/2003 Wu
7,226,307 B1 * 6/2007 Chen et al. ..... 439/352
2007/0243749 A1 * 10/2007 Wu ..... 439/352

* cited by examiner

*Primary Examiner*—Tho D Ta
(74) *Attorney, Agent, or Firm*—C. G. Mersereau; Nikolai & Mersereau, P.A.

(57) ABSTRACT

An electrical connector includes a latch and an activating piece. The latch has at least one hook and a slope. A fulcrum is formed between the hook and the slope. The hook can be combined with an open hole of a guiding frame. The activating piece has an annular structure and a slope structure. The slope structure is provided on the slope. By pulling or releasing the annular structure, the slope structure can push or be separated from the slope. Via the lever principle, the latch makes the hook to ascend or descend. In this way, the electrical connector can be separated from or connected with a corresponding female electrical connector in the guiding frame more easily. Further, the structure of the electrical connector is simple, thereby reducing the manufacturing cost and facilitating the manufacturing and assembling process.

9 Claims, 6 Drawing Sheets

ELECTRICAL CONNECTOR

BACKGROUND OF THE INVENTION

1. Field of the Invention

The present invention is related to an electrical connector, and more particular to a male electrical connector that can be connected with a corresponding female electrical connector.

2. Description of Related Art

In order to increase the port density connected with an Internet apparatus (such as an exchanger, cable insertion panel, wiring box, input/output port for a computer), it is desirable to minimize the receiving/transmitting module. Thus, Small Form-Factor Pluggable (SFP) receiving/transmitting modules are developed to satisfy to this need. The primary advantage of the SFP receiving/transmitting module lies in that its size is very small, so that the density of the communication system can be much larger. However, such kind of connectors have the problem that they may become separated or detached from the components to which they are connected.

A latched electrical connector, especially a male/female electrical connector, can be used to interlock them together securely, so that they cannot be detached from each other easily. For example, U.S. Pat. No. 5,915,987 published on Jun. 29, 1999, discloses a male/female latched electrical connector. The electrical connector has a latch that is connected to the housing of the male electrical connector. However, the latch and a corresponding activating piece may increase the lateral dimension of the male electrical connector, so that it cannot be used with a female electrical connector of a SFP receiving/transmitting module. Further, the male electrical connector requires a housing of a special structure for storage, which brings about inconvenience. Since the electrical connector is minimized continuously, and the amount of terminals in the female electrical connector of an electronic device is increased continuously, it is more and more difficult to design the latch and the activating piece of the male electrical connector and their operation also becomes hard.

Further, U.S. Pat. No. 6,648,665 published on Nov. 18, 2003, discloses a male electrical connector, in which a latch is combined with the housing of the male electrical connector, and the latch extends obliquely and longitudinally along the inner wall of the housing. Since the electrical connector has a plurality of components, the construction thereof is complicated, increasing the manufacturing and assembling cost. Further, the latch is constituted of many separate members, and thus the manufacturing thereof is more difficult.

Consequently, because of the above technical defects, the inventor keeps on carving unflaggingly through wholehearted experience and research to develop the present invention, which can effectively improve the defects described above.

SUMMARY OF THE INVENTION

The object of the present invention is to provide an electrical connector. The electrical connector has a latch. The latch allows the electrical connector to be separated from or connected with a corresponding female electrical connector more easily. Further, the construction of the electrical connector is simpler, thereby reducing the manufacturing cost and facilitating the manufacturing and assembling process.

For achieving the object described above, the present invention provides an electrical connector, which includes: a main body having a front portion and rear portion, the front portion having a first surface, the rear portion having a second surface, the second surface being formed with a first trough and a second trough, the depth of the second trough being larger than that of the first trough, the second surface being provided at a height above the first surface; a pressing piece provided in the first trough of the rear portion; a latch having a first end, a second end and an elastic piece, the first end being bent to form a slope, the second end having at least one hook, the second end extending on the first surface, the elastic piece being warped at a point near the first end in a direction away from the first end, the elastic piece abutting against the bottom surface of the pressing piece, the latch being provided in the second trough; and an activating piece having a first portion protruding from the rear portion and a second portion extending in the first trough, the second portion having a slope structure, the slope structure corresponding to the slope and being located on the slope, a portion of the activating piece being provided between the pressing piece and the bottom of the first trough.

The present invention has advantageous effects as follows. By pulling or releasing the annular structure to make the activating piece to move away from or toward the front portion, the slope structure can push or be separated from the slope. Via the lever principle, the second end of the latch ascends or descends with respect to the first surface of the front portion. In this way, the electrical connector can be separated from or connected with a corresponding female electrical connector more easily. Further, the structure of the electrical connector is simpler, thereby reducing the manufacturing cost and facilitating the manufacturing and assembling process.

In order to further understand the characteristics and technical contents of the present invention, a detailed description is made with reference to the accompanying drawings. However, it should be understood that the drawings are illustrative only but not used to limit the present invention thereto.

DETAILED DESCRIPTION OF THE PREFERRED EMBODIMENTS

Figure 1:
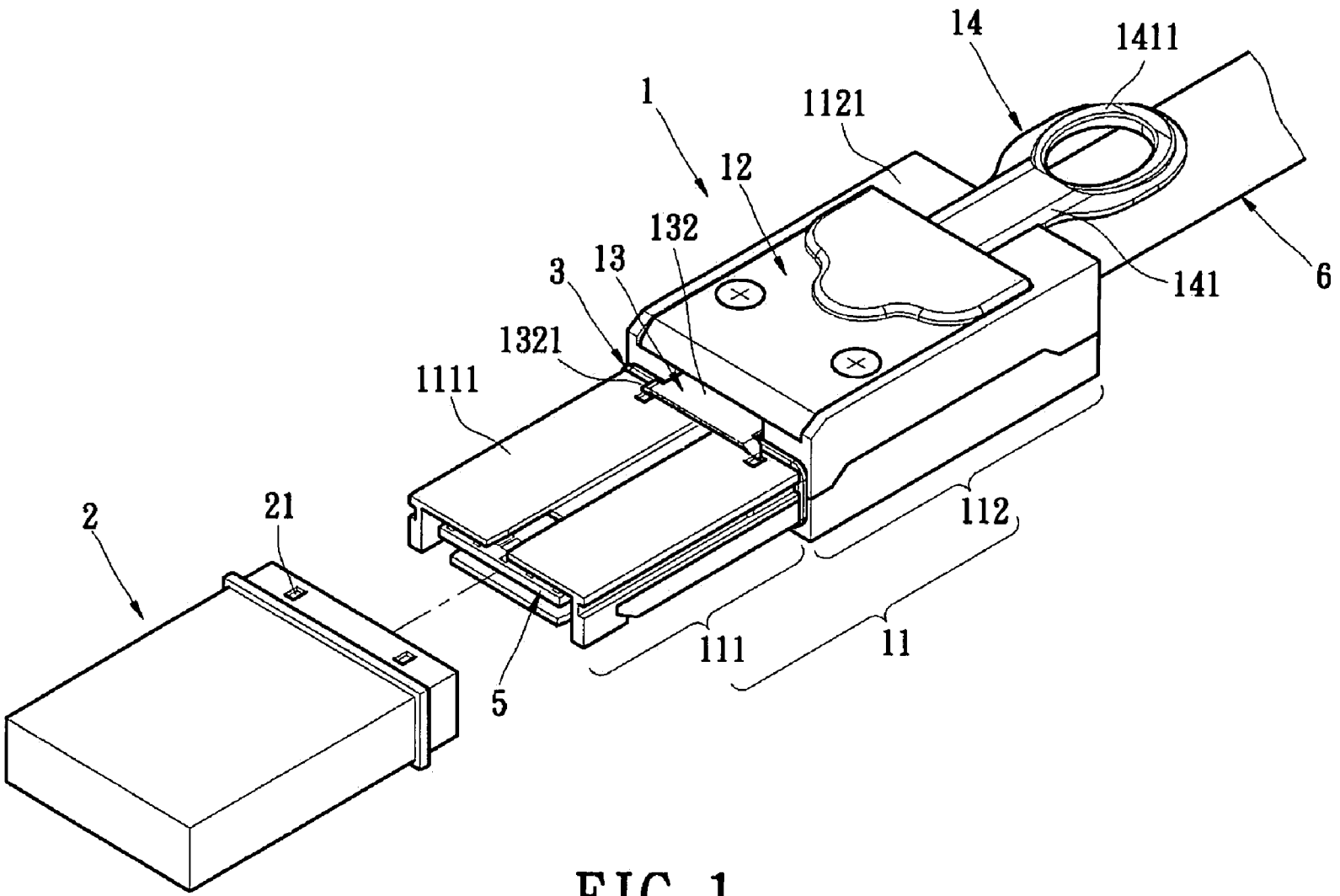
FIG. 1 is a perspective view showing the electrical connector of the present invention and a connecting structure thereof.
Figure 2:
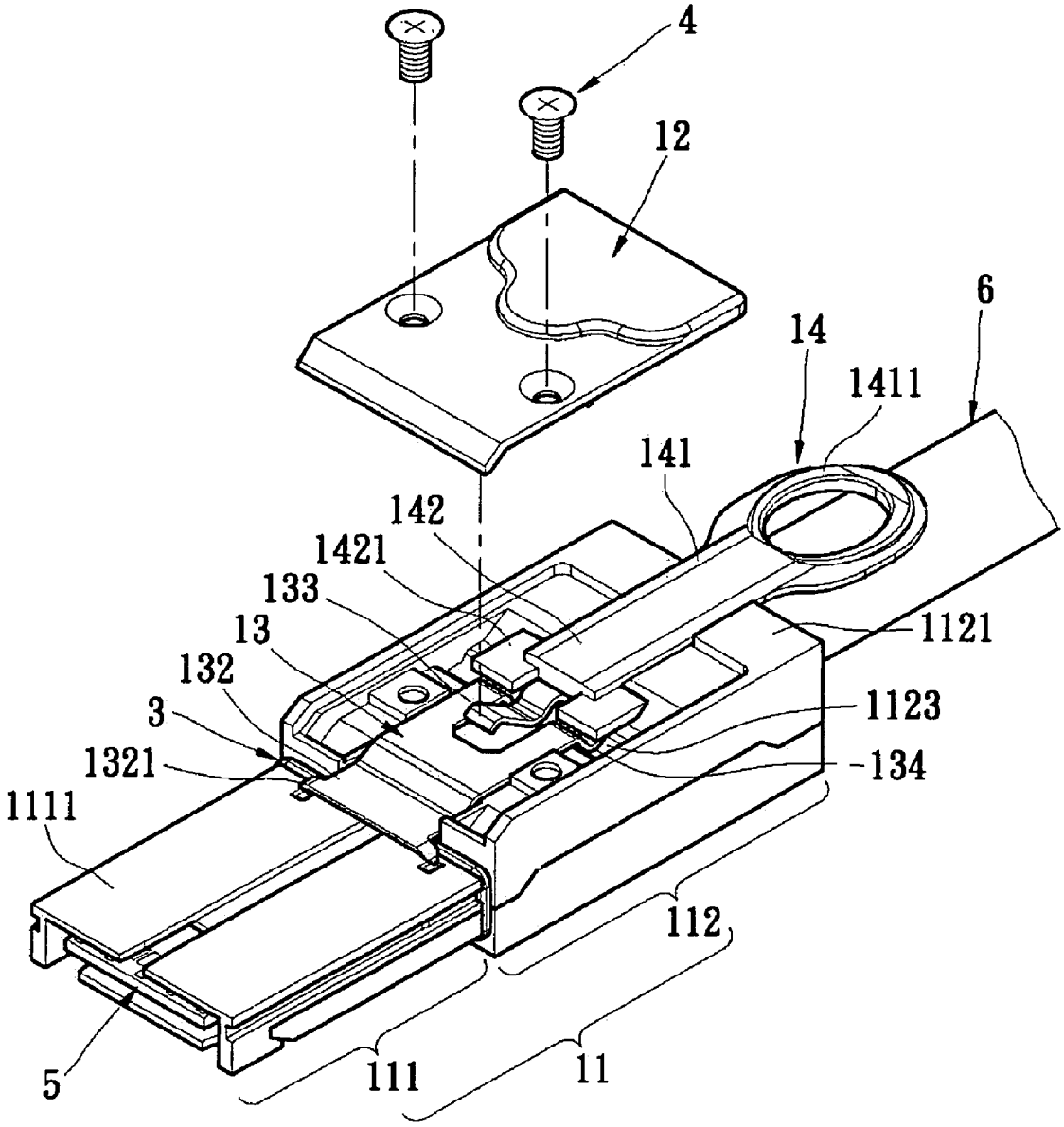
FIG. 2 is a partially exploded perspective view showing the electrical connector of the present invention.
Figure 3:
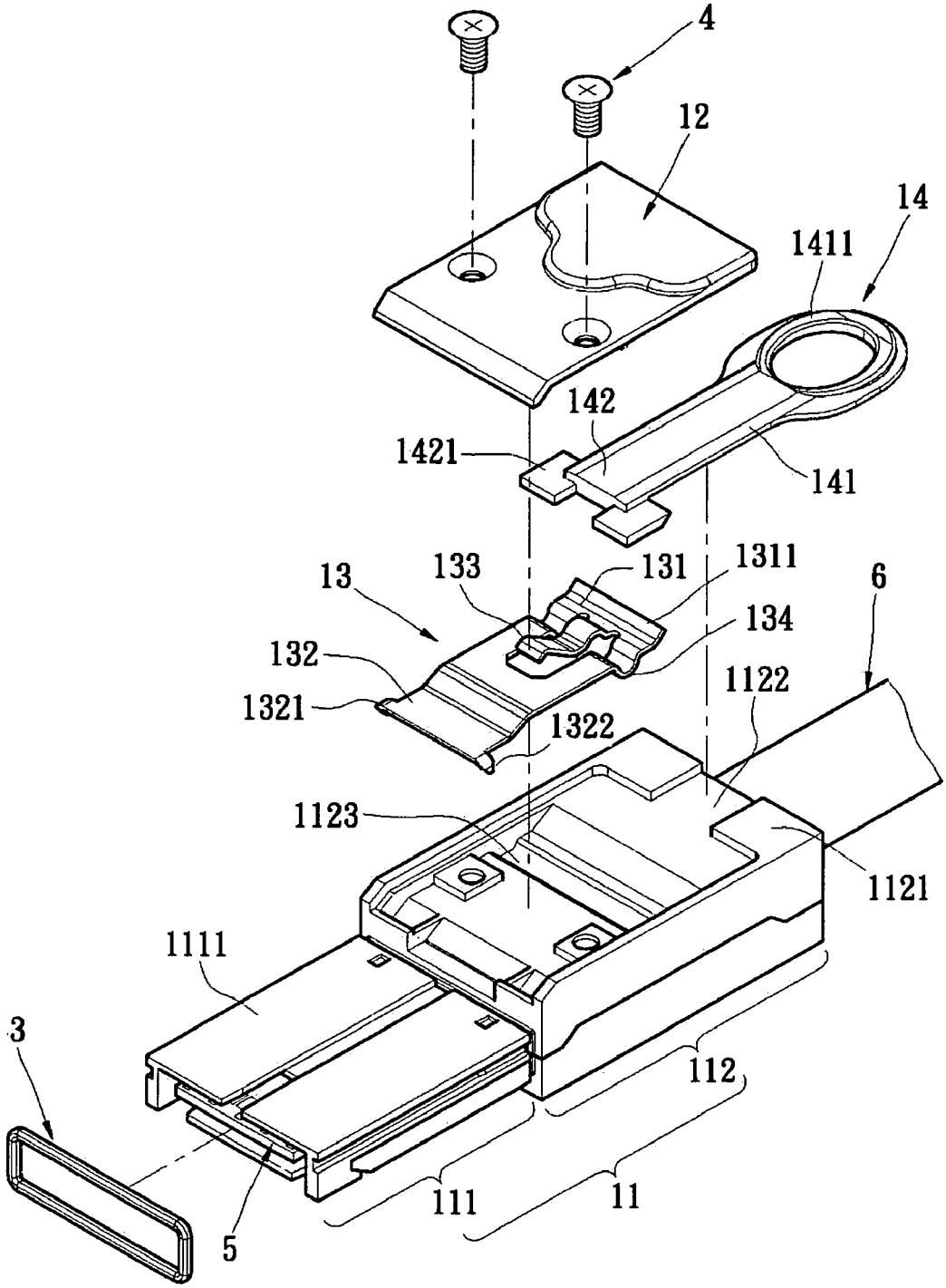
FIG. 3 is a further exploded perspective showing the electrical connector of the present invention.
Figure 4:
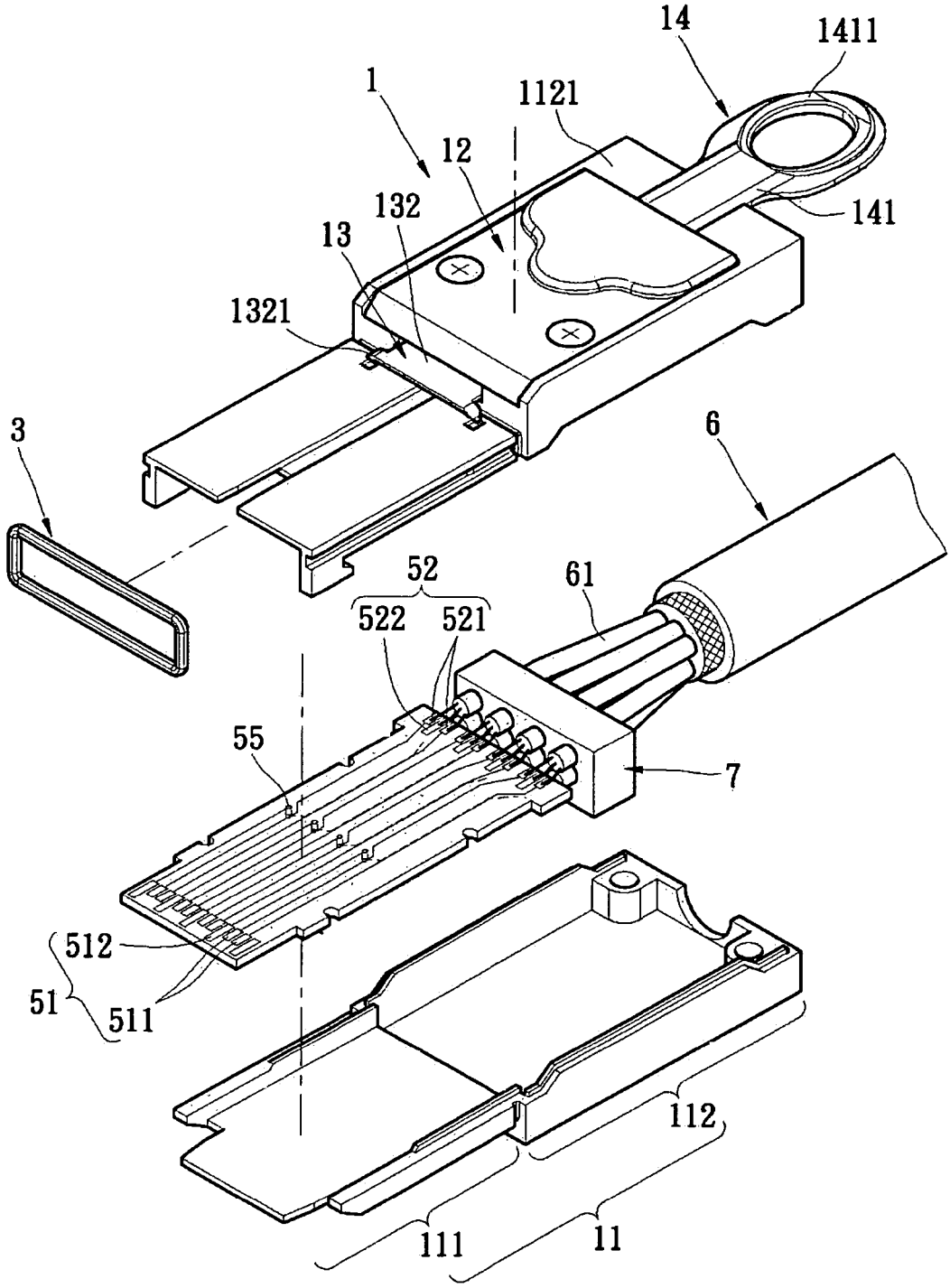
FIG. 4 is a further exploded perspective showing the electrical connector of the present invention.

Please refer to FIGS. 1 to 4 and FIG. 7. The present invention provides an electrical connector 1. The electrical connector 1 can be a male electrical connector for a corresponding female electrical connector (not shown). The electrical connector 1 includes a main body 11, a pressing piece 12, a latch 13 and an activating piece 14. The main body 11 has a front portion 111 and a rear portion 112. The front portion 111 is formed into a rectangular body with a rectangular cross section. The front portion 111 has a first surface 1111. The first surface 1111 is at the top side of the front portion 111 as shown in FIG. 2. The front portion 111 can be inserted into a guiding frame 2. The front portion 111 is connected to the rear portion 112. At the connecting point between the front portion 111 and the rear portion 112, a gasket 3 is provided for preventing electro-magnetic waves.

The rear portion 112 is also formed into a rectangular body with a rectangular cross section. The cross-sectional area and size of the rear portion 112 are larger than those of the front portion 111, thereby preventing the rear portion 112 from being inserted into the guiding frame 2 when the electrical connector 1 is connected with the female electrical connector. The rear portion 112 has a second surface 1121. The second surface 1121 is at the top side of the rear portion 112 as shown in FIG. 2. The second surface 1121 is formed with a first trough 1122 and a second trough 1123. The first trough 1122 extends from a rear end of the rear portion 112 to a front end of the rear portion 112. The second trough 1123 extends from the center of the rear portion 112 to the front end of the rear portion 112. The depth of the second trough 1123 is larger than that of the first trough 1122. The second surface 1121 is provided in a height above the first surface 1111.

In the present embodiment, the pressing piece 12 is formed with a rectangular plate. The pressing piece 12 corresponds to the first trough 1122 and is secured into the first trough 1122 of the rear portion 112 via two screws 4. The pressing piece 12 can be secured into the first trough 1122 via other means.

The latch 13 is made of sheet metal or plastic material with better elasticity. The latch 13 has a first end 131, a second end 132, an elastic piece 133 and a fulcrum 134. The first end 131 is bent to form a slope 1311. A gap is provided between the slope 1311 and the bottom of the second trough 1123. In the present embodiment, the second end 132 has two opposing hooks 1321. However, another number of the hooks 1321 can be used. Each of the two hooks 1321 has a chamfer 1322. The second end 132 extends on the first surface 1111 of the front portion 111. The elastic piece 133 is warped at a point near the first end 131 in a direction away from the first end 131. The elastic piece 133 abuts against the bottom surface of the pressing piece 12. The fulcrum 134 is located between the first end 131 and the second end 132. The fulcrum 134 is provided in the second trough 1123. The fulcrum 134 makes the first end 131 to ascend or descend with respect to the second end 132 via the lever principle.

The activating piece 14 has a thin and elongate shape, and it has a first portion 141 extending from the rear portion 112 and a second portion 142 extending into the first trough 1122. The first portion 141 is formed with an annular structure 1411 that can be gripped easily. The second portion 142 has a slope structure 1421. The slope structure 1421 corresponds to the slope 1311 and is located on the slope 1311. A portion of the activating piece 14 is, provided between the pressing piece 12 and the bottom of the first trough 1122.

The interior of the main body 11 contains a circuit board 5. The front end and the rear end of the circuit board 5 have a plurality of first terminal sets 51 and a plurality of second terminal sets 52 respectively. The first terminal set 51 has two first signal portions 511 and a first grounding portion 512. The first terminal set 51 can be electrically connected with connecting terminals (not shown) of the female electrical connector enclosed in the guiding frame 2.

The second terminal set 52 has two second signal portions 521 and a second grounding portion 522. The first signal portion 51 is electrically connected to the second signal portion 521 in the circuit board 5 via a first circuit 53. The first grounding portion 512 is electrically connected to the second grounding portion 522 in the circuit board 5 via a second circuit 54. The second circuit 54 is prevented from touching the first circuit 53 by means of a through hole 55, thereby preventing a short circuit.

The rear end of the circuit board 5 is connected to a cable 6 by soldering. The cable 6 has therein a plurality of wire bundles 61. The wire bundles 61 can be fixed via a fixing part 7. The wire bundle 61 has two signal sources 611 and a grounding source 612. The two signal sources 611 are connected to the two second signal portions 521 by soldering opposite to the second signal portions 521. The grounding source 612 is connected to the second grounding portion 522 by soldering opposite to the second grounding portion 522, so that the cable 6 can be electrically connected with the electrical connector 1.

Figure 5:
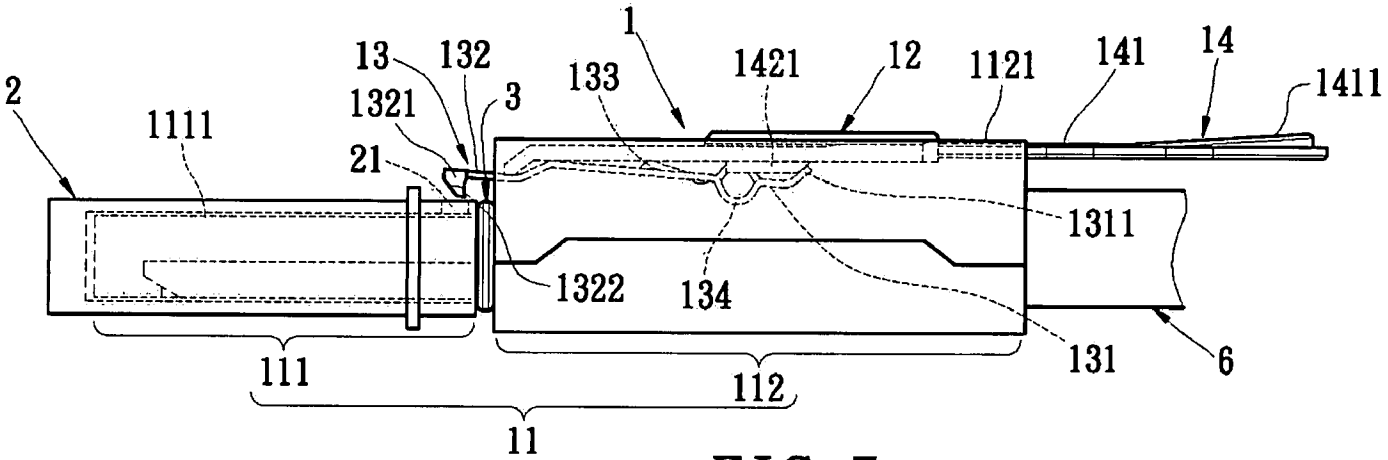
FIG. 5 is a side view showing the latch of the electrical connector of the present invention being separated from the guiding frame.

Please refer to FIG. 5. When the front portion 111 of the electrical connector 1 is inserted into the guiding frame 2, the two hooks 1321 can be connected in an open hole 21 of the guiding frame 2. The two chamfers 1322 can make the two hooks 1321 to lock the electrical connector 1 more firmly. With the annular structure 1411 being pulled, the activating piece 14 can be moved away from the front portion 111, so that the slope structure 1421 can push the slope 1311. At this time, via the lever principle, the latch 13 allows the second end 132 to ascend with respect to the first surface 1111 of the front portion 111 and to press the elastic piece 133. In this way, the two hooks 1321 can be separated from the open hole 21 of the guiding frame 2.

Figure 6:
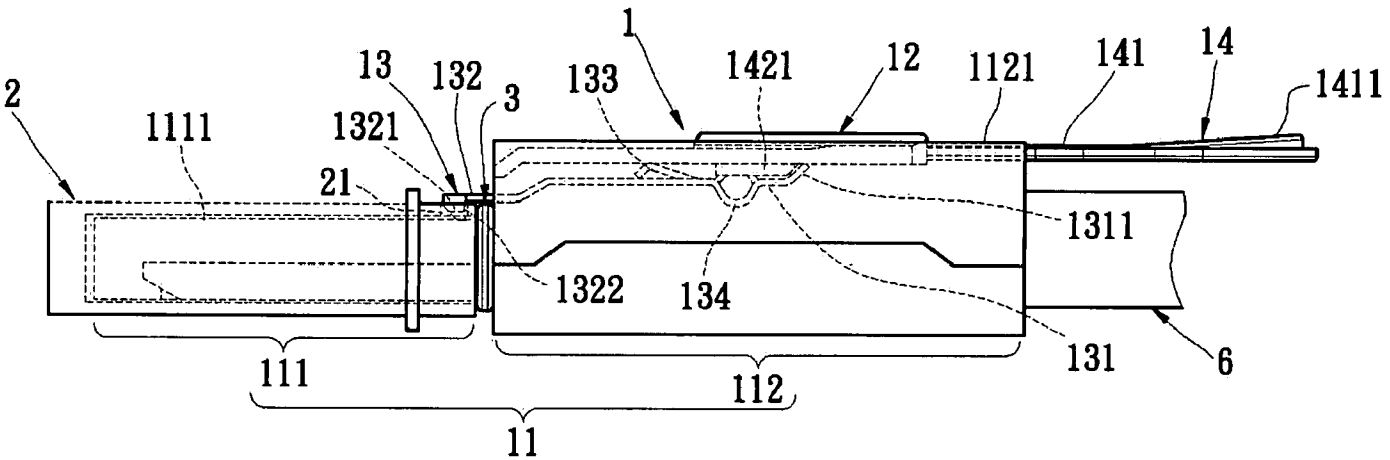
FIG. 6 is a side view showing the latch of the electrical connector of the present invention being combined with the guiding frame.
Figure 7:
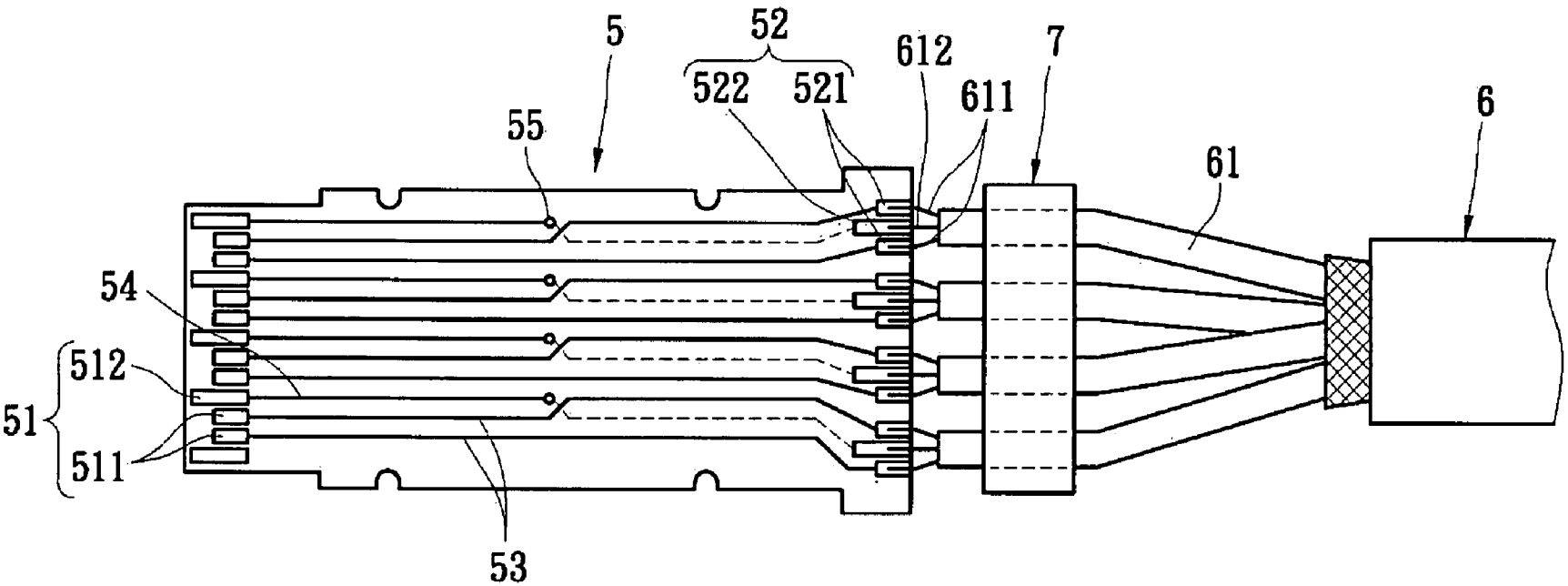
FIG. 7 is a top view showing the circuit board of the electrical connector of the present invention and a cable.

Please refer to FIG. 6. When the annular structure 1411 is released, the elastic force of the elastic piece 133 will make the slope 1311 to push the activating piece 14 to move toward the front portion 111, so that the slope structure 1421 can be separated from the slope 1311. Via the lever principle, the latch 13 makes the second end 132 to descend with respect to the first surface 1111 of the front portion 111, so that the two hooks 1321 can be combined with the open hole 21 of the guiding frame 2.

In the present invention, by pulling or releasing the annular structure 1411 to make the activating piece 14 to move away from or toward the front portion 111, the slope structure 1421 can push or be separated from the slope 1311. Via the lever principle, the second end 132 of the latch 13 ascends or descends with respect to the first surface 1111 of the front portion 111. In this way, the electrical connector 1 can be separated from or connected with a corresponding female electrical connector in the guiding frame 2 more easily. Further, the structure of the electrical connector 1 is simple, thereby reducing the manufacturing cost and facilitating the manufacturing and assembling process.

Further, it is worthy to mention that: the rear end of the circuit board 5 is provided with second terminal sets 52 opposite to the cable 6, so that the cable 6 can keep the original arrangement of the wires. The grinding source 612 within the wire bundle 61 needs not to be wounded and soldered to the second grounding portion 522, thereby reducing the electromagnetic interference. As a result, the signal transmission between the electrical connector 1 and the cable 6 is steadier.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electrical connector, comprising;

a main body having a front portion and rear portion, the front portion having a first surface, the rear portion having a second surface, the second surface being formed with a first trough and a second trough, the depth of the second trough being larger than that of the first trough, the second surface being provided at a height above the first surface;

a pressing piece provided in the first trough of the rear portion;

a latch having a first end, a second end and an elastic piece, the first end being bent to form a slope, the second end having at least one hook, the second end extending on the first surface, the elastic piece being warped at a point near the first end in a direction away from the first end, the elastic piece abutting against the bottom surface of the pressing piece, the latch being provided in the second trough; and an activating piece having a first portion protruding from the rear portion and a second portion extending in the first trough, the second portion having a slope structure, the slope structure corresponding to the slope and being located on the slope, a portion of the activating piece being provided between the pressing piece and the bottom of the first trough.

2. The electrical connector according to claim 1, wherein the first surface is at the top side of the front portion, and the second surface is at the top side of the rear portion.

3. The electrical connector according to claim 1, wherein the pressing piece is secured into the first trough of the rear portion via two screws.

4. The electrical connector according to claim 1, wherein a fulcrum is formed between the first end and second end of the latch, and the fulcrum is provided in the second trough.

5. The electrical connector according to claim 1, wherein the first portion of the activating piece protrudes from the rear portion of the main body and is formed with an annular structure.

6. The electrical connector according to claim 1, wherein the front portion is connected with the rear portion, and the connecting point there between is provided with a gasket for preventing electro-magnetic waves.

7. The electrical connector according to claim 1, wherein the main body contains a circuit board, and the front end and the rear end of the circuit board have a plurality of first terminal sets and a plurality of second terminal sets respectively, the first terminal set has two first signal portions and a first grounding portion, the second terminal set has two second signal portions and a second grounding portion, the first signal portion is electrically connected to the second signal portion in the circuit board via a first circuit, the first grounding portion is electrically connected to the second grounding portion in the circuit board via a second circuit, the second circuit is prevented from touching the first circuit by means of a through hole.

8. The electrical connector according to claim 7, wherein the rear end of the circuit board is connected to a cable by soldering, the cable has therein a plurality of wire bundles, each wire bundle has two signal sources and a grounding source, the two signal sources are connected to the two second signal portions by soldering, the grounding source is connected to the second grounding portion by soldering.

9. The electrical connector according to claim 1, wherein the hook of the second end of the latch has a chamfer.

* * * * *